United States Patent [19]

Takamatsu et al.

[11] 4,216,942

[45] Aug. 12, 1980

[54] DOUBLE-DRUM WINCH

[75] Inventors: Takehiko Takamatsu; Akihiro Toyomura; Masami Hashimoto, all of Hirakata, Japan

[73] Assignee: Kabushiki Kaisha Komatsu Seisakusho, Tokyo, Japan

[21] Appl. No.: 25,610

[22] Filed: Mar. 30, 1979

[30] Foreign Application Priority Data

Mar. 31, 1978 [JP] Japan ..... 53/36585

[51] Int. Cl.[2] ..... B66D 1/26

[52] U.S. Cl. ..... 254/310; 192/4 R; 254/299

[58] Field of Search ..... 254/185 B, 185 R, 185 AB; 192/4 R, 18 A, 12 C; 212/55, 39 A

[56] References Cited

U.S. PATENT DOCUMENTS

| | | | |
|---|---|---|---|
| 3,895,699 | 7/1975 | Mita et al. | 254/185 B X |
| 4,033,554 | 7/1977 | Sugimoto et al. | 254/185 B |

*Primary Examiner*—John M. Jillions
*Attorney, Agent, or Firm*—Armstrong, Nikaido, Marmelstein & Kubovcik

[57] ABSTRACT

A double-drum winch having a single power transmission train for both a hook drum and a boom drum.

The power transmission train comprises a high speed clutch and a low speed clutch mounted on a single first clutch shaft which is in turn mounted for rotation on a winch frame, a hook lowering clutch and a boom lowering clutch mounted on a single second clutch shaft which is in turn rotatably mounted on the frame, and a hook hoisting clutch and a boom hoisting clutch mounted on a single third clutch shaft which is in turn rotatably mounted on the frame, the second clutch shaft being located between the first and third clutch shafts and engageable with both the clutch shafts. The power transmission train is connected with the hook drum and the boom drum via a hook brake shaft and a boom brake shaft, respectively.

4 Claims, 9 Drawing Figures

DOUBLE-DRUM WINCH

BACKGROUND OF THE INVENTION

This invention relates to a double-drum winch for use in side cranes of construction vehicles wherein a single central power transmission train is provided for both hook and boom drums.

Conventional winches of the kind specified heretofore in use comprises two power transmission trains; that is, one for power to a boom drum. Therefore, the conventional winch means is disadvantageous in that the power is transmitted via two separately provided transmission trains, that is, one for the hook and the other for the boom, and therefore generation of a high power loss is unavoidable and the structure thereof becomes complicated and large.

SUMMARY OF THE INVENTION

It is therefore an object of the present invention to provide a double-drum winch having a hook drum and a boom drum in which a single power transmission train is provided for both the hook drum and the boom drum.

Another object of the present invention is to provide a double-drum winch which is simple in construction and has a significantly improved power transmission efficiency.

In accordance with an aspect of the present invention, there is provided a double-drum winch having a single power transmission train for both a hook drum and a boom drum. The double-drum winch broadly comprises a winch frame, a prime mover, a drive shaft rotatably mounted on said frame, said drive shaft being connected with and rotated by said prime mover, a single at an approximately central part of said winch frame, said single power transmission train being operatively connected with said drive shaft, a hook brake shaft rotatably mounted on said frame, said hook brake shaft having a hook brake means mounted thereon and being operatively connected with said single power transmission train, a boom brake shaft rotatably mounted on said frame, said boom brake shaft having a boom brake means mounted thereon and being operatively connected with said single power transmission train, a hook drum rotatably mounted on a support shaft which is in turn fixedly mounted on said frame, said hook drum being connected with and rotated by said hook brake shaft, and a boom drum rotatably mounted on said support shaft, said boom drum being connected with and rotated by said boom brake shaft.

The power transmission train comprises a high speed clutch and a low speed clutch both mounted on a single first clutch shaft which is in turn rotatably mounted on said winch frame, a hook lowering clutch and a boom lowering clutch both mounted on a single second clutch shaft which is in turn rotatably mounted on said frame, and a hook hoisting clutch and a boom which is in turn rotatably mounted on said frame, said second clutch shaft being located between said first and third clutch shafts and engageable with both said clutch shafts by gear means each being mounted on said respective clutch shafts.

The above and other objects, features and advantages of the present invention will be readily apparent from the following description taken in conjunction with the accompanying drawings.

DETAILED DESCRIPTION OF THE INVENTION

Figure 1:
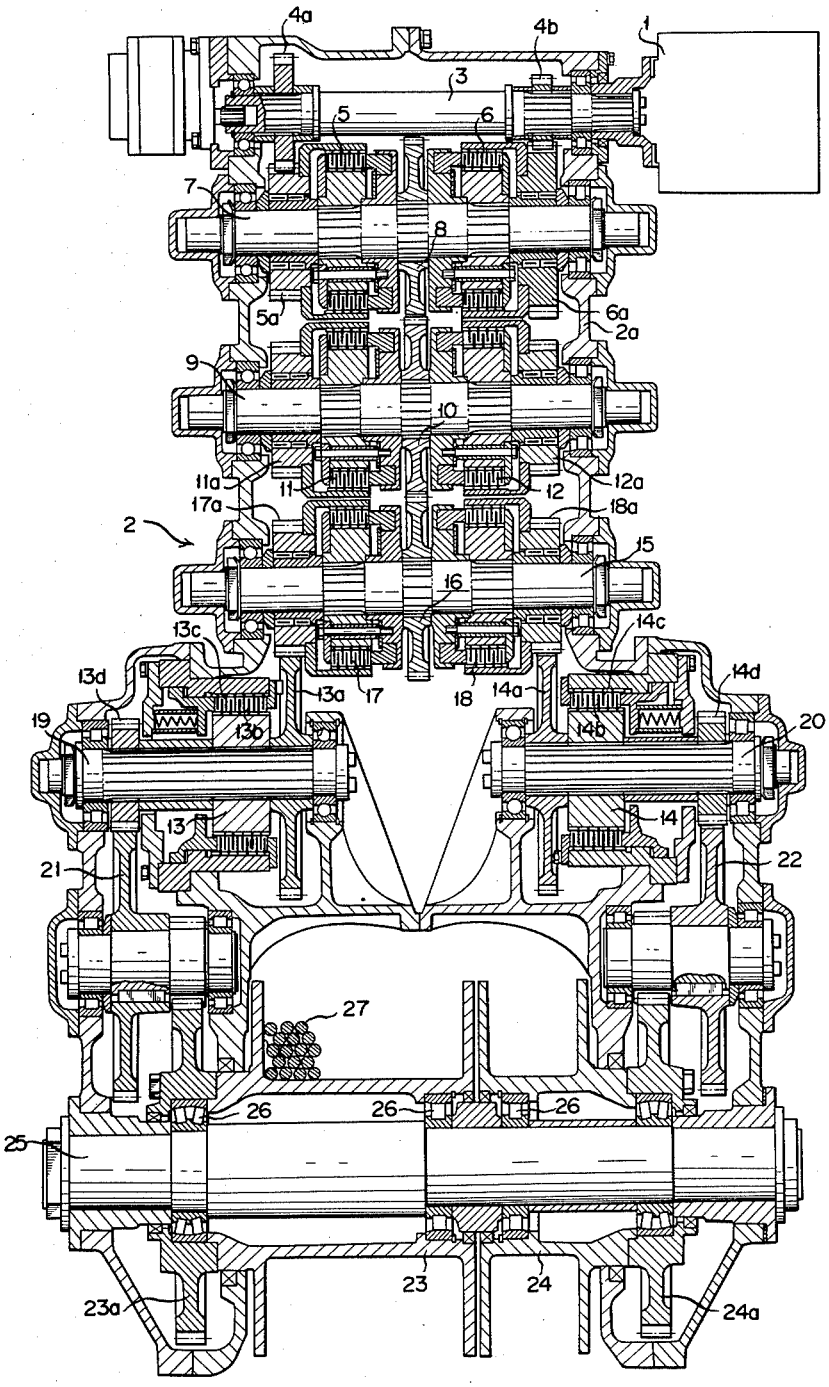
FIG. 1 is a longitudinal cross-sectional view of a double-drum winch according to the present invention.

The present invention will now be described by way of an embodiment with reference to the accompanying drawings. Reference numeral 1 denotes a prime mover means such as an engine etc. mounted on a construction vehicle not shown, said prime mover means being located on one side of a winch body 2 and connected with one end of a drive shaft 3 accommodated in a casing **2*a* of the winch body 2. Two sets of drive gears 4*a* and 4*b* are fixedly secured to the drive shaft 3, said drive gears 4*a* and 4*b* being located in an axially spaced apart relationship. Engaged with the drive gears 4*a* and 4*b* are gear 5*a* mounted on the input side of a high speed clutch 5 and gear 6*a* mounted on the input side of a low speed clutch 6, respectively. The high speed clutch 5 and the low speed clutch 6 are mounted on a clutch shaft 7 both ends of which are rotatably carried by the casing 2*a*, and the output sides of the clutches 5 and 6 are directly connected with said clutch shaft 7. Mounted between the high speed clutch 5 and the low speed clutch 6 is a first gear 8 fixedly secured to the clutch shaft 7. The first gear 8 is engaged with a second gear 10 fixedly mounted on a clutch shaft 9 which extends in parallel relationship with the above-mentioned clutch shaft 7 and both ends of which are rotatably carried by the casing 2*a*. Mounted on both sides of the second gear 10 are a hook lowering clutch 11 and a boom lowering clutch 12, respectively, the input sides of said clutches 11 and 12 being directly connected with the above-mentioned clutch shaft 9. Mounted on the output sides of the hook lowering clutch 11 and the boom lowering clutch 12 are gears 11*a* and 12*a* which are engaged through intermediate gears (not shown) with gears 13*a* and 14*a* mounted on brake shafts 19 and 20 of a hook brake 13 and a boom brake 14** which will be described later.

Whilst engaged with the second gear 10 fixedly secured to the clutch shaft 9 is a third gear 16 fixedly secured to a clutch shaft 15 which extends in parallel relationship with the above-mentioned shaft 9 and both ends of which are rotatably carried by the casing **2*a***.

Figure 2:
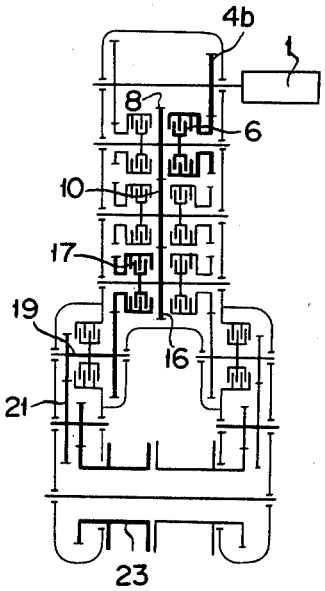
FIG. 2 is a schematic construction view of the winch of FIG. 1 showing a mode of operation wherein a hook is hoisted at a low speed.

The third gear 16 is fixedly secured to the central part of the clutch shaft 15. Mounted on both sides of the third gear 16 are a hook hoisting clutch 17 and 18 being directly connected with the clutch shaft 15. Gears 17*a* and 18*a* mounted on the output sides of the hoisting clutches 17 and 18 are engaged with the gears 13*a* and 14*a* fixedly secured to the brake shafts 19 and 20 of the hook brake 13 and the boom brake 14, respectively. Each of the brake shafts 19 and 20 is independently carried by the casing 2*a* at both ends thereof. 20 are the above-mentioned gears 13*a* and 14*a*. A plurality of disks 13*b* and 14*b* are splined with the central parts of each of the brake shafts 19 and 20. Plates 13*c* and 14*c* adapted to be urged against the disks 13*b* and 14*b*, respectively, are fixedly secured to the casing 2*a*, and gears 13*d* and 14*d* fixedly secured to the other end of each of the brake shafts 19 and 20 are engaged through reduction gears 21 and 22 with gears 23*a* and 24*a* of a hook drum 23 and a boom drum 24, respectively. The hook drum 23 and the boom drum 24 are rotatably carried by bearings 26 so as to be independently rotated on a single drum shaft 26, both ends of which are carried by the casing 2*a*. The leading ends of wires wound round the drums 23 and 24 are connected The operation of the double-drum winch constructed as mentioned above will now be described below. When it is desired to hoist the hook at a low speed, both the low speed clutch 6 and the hook hoisting clutch 17 are turned on. Thus, rotation of the prime mover 1 is transmitted, as shown in FIG. 2, from the low speed clutch 6 through the first gear 8, the 17, and then through the brake shaft 19 and the reduction gear 21 to the hook drum 23 thereby rotating the hook drum 23, and winding up the wire 27 so as to hoist the hook.

Figure 3:
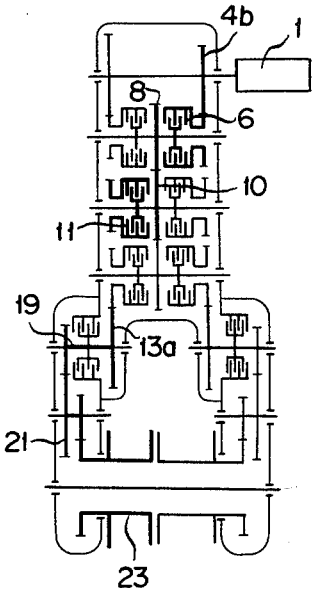
FIG. 3 is similar to FIG. 2 but showing a mode of operation wherein the hook is lowered at a low speed.

Further, when it is desired to lower the hook at a low speed, it is only necessary to turn on the low speed clutch 6 and the hook lowering clutch 11. By doing so, as shown in FIG. 3, rotation of the prime mover 1 is transmitted through the low speed clutch 6 to the first gear 8 and the second gear 10. The rotation of the second gear 10 is transmitted through the hook lowering clutch 11, the aforementioned intermediate gear not shown, the gear 13*a* of the brake shaft 19 and further through the reduction gear 21 to the hook drum 23 so as to rotate the drum 23 thereby lowering the hook.

Figure 4:
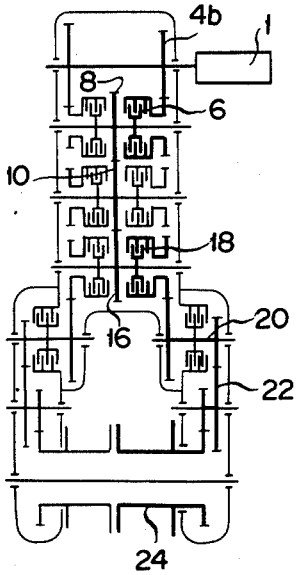
FIG. 4 is similar to FIG. 2 but showing a mode of operation wherein a boom is hoisted at a low speed.

When the boom is hoisted at a low speed, the low speed clutch 6 and the boom hoisting clutch 18 are both turned on. By so doing, as shown in FIG. 4, the rotation of the prime mover 1 is transmitted through the low speed clutch 6, the first gear 8, the second gear 10 and the third gear 16 to the boom hoisting clutch 18, and further through the brake shaft 20 and the reduction gear 22 to the boom drum 24 so as to rotate the drum 24 thereby hoisting the boom at a low speed.

Figure 5:
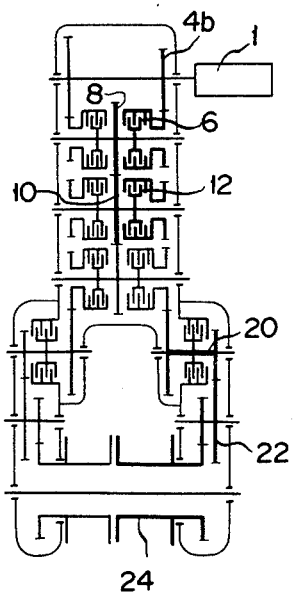
FIG. 5 is similar to FIG. 2 but showing a mode of operation wherein the boom is lowered at a low speed.

When it is desired to lower the boom at a low speed, the low speed clutch 6 and the boom lowering clutch 12 are both turned on. By so doing, as shown in FIG. 5, the rotation of the prime mover 1 is transmitted through the low speed clutch 6, the first gear 8 and the second gear 10 to the boom hoisting clutch 12, and further through the aforementioned intermediate gear not shown, the brake shaft 20 and the reduction gear 22 to the boom drum 24 so as to rotate the drum 24 thereby lowering the boom at a low speed.

Further, when the hook and boom are hoisted and lowered at a high speed, the rotation of the prime mover 1 is transmitted through the high speed clutch 5 to the first gear 8, and the operation thereafter is same as in the aforementioned case of low speed operation. Therefore, the description of the operation after that is omitted.

Figure 6:
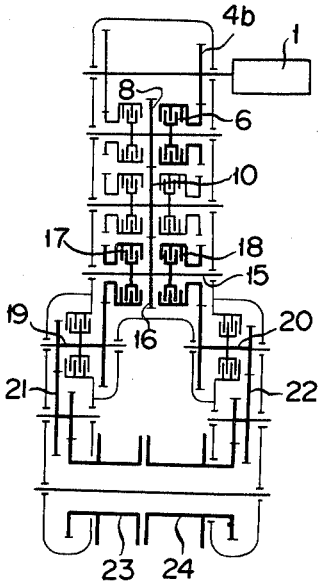
FIG. 6 is similar to FIG. 2 but showing a mode of operation wherein both the hook and the boom are hoisted simultaneously at a low speed.

Next, simultaneous operation of the hook and boom will be described below. When it is desired to hoist the hook and boom simultaneously at a low speed, the low speed clutch 6, the hook hoisting clutch 17 and the boom hoisting clutch 18 are all turned on. By so doing, as shown in FIG. 6, rotation of the first gear 8, the second gear 10 and the third gear 16 to the clutch shaft 15, and further through the hook hoisting clutch 17, the boom hoisting clutch 18, brake shafts 19 and 20 and the reduction gears 21 and 22 to the hook drum 23 and the boom drum 24 so as to rotate the drums 23 and 24 thereby hoisting the hook and the boom at a low speed.

Figure 7:
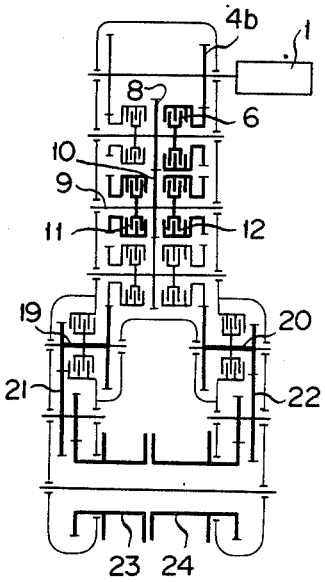
FIG. 7 is similar to FIG. 2 but showing a mode of operation wherein both the hook and the boom are lowered simultaneously at a low speed.

When lowering the hook and the boom simultaneously at a low speed, the low speed clutch 6, the hook lowering clutch 11 and the boom lowering clutch 12 are all turned on. By so doing, as shown in FIG. 7, rotation of the prime mover 1 is transmitted through the low speed clutch 6, the first gear 8 and the second gear 10 to the clutch shaft 9. Further, rotation of the clutch shaft 9 is transmitted through the hook lowering clutch 11 and the boom lowering clutch 12 and the aforementioned intermediate gears not shown to the brake shafts 19 and 20 thereby rotating the shafts 19, 20 and further through the reduction gears 21 and 22 to the hook drum 23 and the boom drum 24 so as to rotate the drums 23 and 24 thereby lowering the hook and the boom at a low speed.

Further, when hoisting and lowering the hook and the boom simultaneously at a high speed, rotation of the prime mover 1 is transmitted through the high speed clutch 5 to the first gear 8, and the operation thereafter is same as in the abovementioned case, and therefore the description thereof is omitted.

Figure 8:
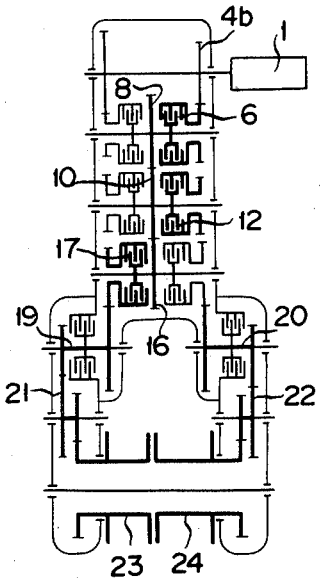
FIG. 8 is similar to FIG. 2 but showing a mode of operation wherein the hook is hoisted and the boom is lowered simultaneously at a low speed.

When it is desired to hoist the hook and lower the boom simultaneously at a low speed, the low speed clutch 6, the boom lowering clutch 12 and the hook hoisting clutch 17 are all turned on. By so doing, as shown in FIG. 8, rotation of the prime mover 1 is transmitted, through the low speed clutch 6, the first gear 8 and the second gear 10, partly to the boom lowering clutch 12 and partly through the third gear 16 to the hook lowering clutch 17. The rotation of the boom lowering clutch 12 is transmitted through the aforementioned intermediate gear not shown to the brake shaft 20 so as to rotate the shaft 20, and further through the reduction gear 22 to the boom drum 24 so as to rotate the drum 24 thereby lowering the boom. Whilst the rotation of the hook hoisting clutch 17 is transmitted through the brake shaft 19 and the reduction gear 21 to the hook drum 23 so as to rotate the drum 23 thereby hoisting the hook.

Figure 9:
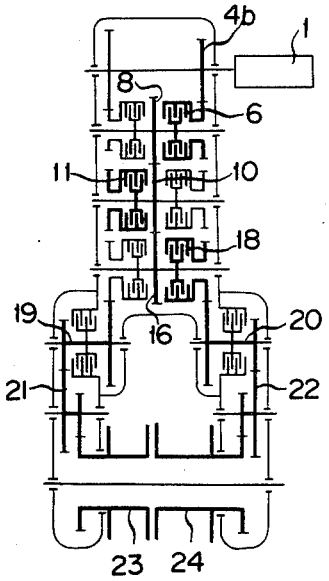
FIG. 9 is similar to FIG. 2 but showing a mode of operation wherein the hook is lowered and the boom is hoisted simultaneously at a low speed.

Reversely, when it is desired to lower the hook and hoist the boom simultaneously at a low speed, the low speed clutch 6, the hook lowering clutch 11 and the boom hoisting clutch 18 are all turned on. By so doing, as shown in FIG. 9, the rotation of the prime mover 1 is transmitted through the low speed clutch 6, the first gear 8 and the second gear 10, partly to the hook lowering clutch 11, and partly through the third gear 16 to the boom hoisting clutch 18. The rotation of the hook lowering clutch 11 is transmitted through the aforementioned further through the reduction gear 21 to the hook drum 23 so as to rotate the drum 23 thereby lowering the hook at a low speed. On the other hand, the rotation of the boom hoisting clutch 18 is transmitted through the brake shaft 20 and the reduction gear 22 to the boom drum 24 so as to rotate the drum 24 thereby hoisting the boom at a low speed.

Further, when the hook and the boom are hoisted or lowered, respectively, in the opposite directions at a high speed, the rotation of the prime mover 1 is transmitted through the high speed clutch 5 to the first gear 8, and the operation thereafter is same as in the above-mentioned case, and so the description thereof is omitted.

As mentioned in detail hereinabove, according to the present invention, a single and central power transmission train or system is provided for transmitting the rotation of the prime mover to both the hook drum and the boom drum, and high and low speed clutches and hoisting and lowering clutches are located on both sides of the power transmission system. Therefore, as compared with the conventional system wherein independent or separate power transmission trains are provided for the hook and the boom, respectively, the overall system becomes more compact and the structure per se can be simplifed. Further, because the power of the prime mover is transmitted from a single power transmission train to a hook drum and a boom drum, as compared with the conventional system wherein the power is transmitted through two sets of power transmission trains, the power transmission loss can be reduced remarkably thereby enabling more effective power utilization to be achieved.

It is to be understood that the above description is by way of example only, and that details for carrying the invention into effect may be varied without departing from the scope of the invention claimed.

What is claimed is:

1. A double-drum winch having a hook drum and a boom drum mounted therein comprising a winch frame;

prime mover means fixedly mounted on said frame;

a drive shaft rotatably mounted on said frame, said drive shaft being connected with and rotated by said prime mover means;

a first clutch shaft rotatably mounted on said frame, said first clutch shaft having a first gear fixedly secured thereon, a high speed clutch mounted thereon and a low speed clutch mounted thereon, said high and low speed clutches being mounted oppositely relative to said first gear;

a second clutch shaft rotatably mounted on said frame, said second clutch shaft having a second gear engageable with said first gear fixedly mounted thereon, a hook lowering clutch mounted thereon and a boom lowering clutch mounted thereon, said hook and boom lowering clutches being mounted oppositely relative to said second gear;

a third clutch shaft rotatably mounted on said frame, said third clutch shaft having a third gear engageable with said second gear fixedly mounted thereon, a hook hoisting clutch mounted thereon and a boom hoisting clutch mounted thereon, said hook and boom hoisting clutches being mounted oppositely relative to said third gear;

a hook brake shaft rotatably mounted on said frame, said hook brake shaft having hook brake means mounted thereon and being selectively connectible for rotation with said second and third clutch shafts;

a boom brake shaft rotatably mounted on said frame, said boom brake shaft having boom brake means mounted thereon and being selectively connectible for rotation with said second and third clutch shafts; and a drum shaft fixedly mounted on said frame, said drum shaft having the hook drum and the boom drum rotatably mounted thereon, said hook drum being connected with said hook brake shaft and said boom drum being connected with said boom brake shaft.

2. A double-drum winch as defined in claim 1 wherein said high and low speed clutches are alternately engageable and wherein the input sides of said high and low speed clutches are connected for rotation with said drive shaft, and the output sides thereof are fixedly mounted on said first clutch shaft.

3. A double-drum winch as defined in claim 2 wherein the input sides of said hook and boom lowering clutches are fixedly mounted on said second clutch shaft and wherein the input sides of said hook and boom hoisting clutches are fixedly mounted on said third clutch shaft.

4. A double-drum winch as defined in claim 1, 2 or 3 wherein said hook and boom brake means comprise disc brakes.

* * * * *